US011470416B2

(12) United States Patent
Wen

(10) Patent No.: US 11,470,416 B2
(45) Date of Patent: Oct. 11, 2022

(54) METHOD AND DEVICE FOR DETECTING EARPHONE WEARING STATUS, AND EARPHONE

(71) Applicant: GOERTEK INC., Shandong (CN)

(72) Inventor: Xiaofeng Wen, Shandong (CN)

(73) Assignee: Goertek, Inc., Weifang (CN)

( * ) Notice: Subject to any disclaimer, the term of this patent is extended or adjusted under 35 U.S.C. 154(b) by 0 days.

(21) Appl. No.: 17/267,562

(22) PCT Filed: Dec. 27, 2018

(86) PCT No.: PCT/CN2018/124139

§ 371 (c)(1),
(2) Date: Feb. 10, 2021

(87) PCT Pub. No.: WO2020/034544

PCT Pub. Date: Feb. 20, 2020

(65) Prior Publication Data

US 2021/0266658 A1 Aug. 26, 2021

(30) Foreign Application Priority Data

Aug. 16, 2018 (CN) ..... 201810937202.7

(51) Int. Cl.

| | |
|---|---|
| ***H04R 1/10*** | (2006.01) |
| ***G10L 25/51*** | (2013.01) |
| ***H04R 1/08*** | (2006.01) |
| ***H04R 29/00*** | (2006.01) |

(52) U.S. Cl.
CPC ..... *H04R 1/1083* (2013.01); *G10L 25/51* (2013.01); *H04R 1/08* (2013.01); *H04R 1/1041* (2013.01); *H04R 29/001* (2013.01)

(58) Field of Classification Search
CPC ..... H04R 1/1083; H04R 1/08; H04R 1/1041; H04R 29/001; G10L 25/51
See application file for complete search history.

(56) References Cited

U.S. PATENT DOCUMENTS

2012/0207319 A1 8/2012 Tsuchiya et al.
2012/0250873 A1* 10/2012 Bakalos ..... G10K 11/17854 381/71.8
2014/0126733 A1* 5/2014 Gauger, Jr. ..... G10K 11/17835 381/71.6

(Continued)

FOREIGN PATENT DOCUMENTS

CN 103339960 A 10/2013
CN 103581796 A 2/2014

(Continued)

*Primary Examiner* — Simon King
(74) *Attorney, Agent, or Firm* — Baker Botts, L.L.P.

(57) ABSTRACT

Disclosed are methods and devices for detecting wearing status of an earphone. An example method comprises: acquiring an environment type comprising a noise environment type and a non-noise environment type; when the earphone is in the non-noise environment type, the earphone plays a preset audio signal; acquiring a feedforward and a feedback sound pressure of the earphone to determine a difference therebetween; determining, according to a comparison result of the difference and a preset first threshold range corresponding to the environment type, whether the earphone is worn properly.

11 Claims, 2 Drawing Sheets

(56) References Cited

U.S. PATENT DOCUMENTS

| | | | | |
|---|---|---|---|---|
| 2014/0126734 | A1* | 5/2014 | Gauger, Jr. ..... | H04R 1/1083<br>381/71.6 |
| 2014/0126735 | A1* | 5/2014 | Gauger, Jr. ..... | G10K 11/17837<br>381/71.6 |
| 2014/0126736 | A1* | 5/2014 | Gauger, Jr. ..... | G10K 11/17837<br>381/71.6 |
| 2014/0126756 | A1* | 5/2014 | Gauger, Jr. ..... | G10K 11/17857<br>381/71.6 |
| 2017/0148428 | A1* | 5/2017 | Thuy ..... | H04R 1/1083 |

FOREIGN PATENT DOCUMENTS

| | | | |
|---|---|---|---|
| CN | 104506987 | A | 4/2015 |
| CN | 106982403 | A | 7/2017 |
| CN | 107959903 | A | 4/2018 |

* cited by examiner

METHOD AND DEVICE FOR DETECTING EARPHONE WEARING STATUS, AND EARPHONE

CROSS-REFERENCE TO RELATED APPLICATIONS

This application claims priority to Chinese Patent Application No. 201810937202.7, filed with the Chinese Patent Office on Aug. 16, 2018 and entitled "METHOD AND DEVICE FOR DETECTING EARPHONE WEARING STATUS, AND EARPHONE", the content of which is incorporated herein by reference in its entirety.

TECHNICAL FIELD

The present disclosure relates to the technical field of acoustics, and more specifically, to a method and a device for detecting wearing status of an earphone, and an earphone.

BACKGROUND

With improvement of living standards, an earphone has become an indispensable electronic device in people's daily life and work. For noise-reducing earphones, they convert electrical signals into acoustic signals during their use, and meanwhile may also perform active noise reduction processing on external noise.

Currently, earphones are generally classified into three categories according to their respective ways of noise reduction during active noise reduction: feedforward noise reduction, feedback noise reduction, and a combination thereof known as hybrid noise reduction. Among them, earphones using the feedback noise reduction are featured by noise reduction performance and sound quality that vary as a function of wearing status of the earphone. Specifically, an earphone will have a good noise reduction performance when it is worn in a correct way, i.e., worn with a good coupling; meanwhile, speakers in the earphone will be good in low frequency response, i.e., good in sound quality. By contrast, the earphone will have a poor noise reduction performance when it is worn in an incorrect way, i.e., worn with a poor coupling; meanwhile, the earphone will be poor in sound quality.

In summary, to detect the wear coupling status of the earphone has become an urgent problem to be solved, in order to improve noise reduction performance and sound quality of the earphone.

SUMMARY

An object of the present disclosure is to provide a method and a device for detecting wearing status of an earphone and an earphone, which can detect wearing status of the earphone.

According to a first aspect of the present disclosure, a method for detecting wearing status of an earphone is provided, comprising:

acquiring an environment type in which environment an earphone is located, wherein the environment type comprises a noise environment type and a non-noise environment type; playing a preset audio signal via the earphone when the earphone is in the non-noise environment type;

acquiring a feedforward sound pressure and a feedback sound pressure of the earphone to determine a difference between the feedforward sound pressure and the feedback sound pressure, wherein the feedforward sound pressure is a sound pressure of a sound signal picked up by a feedforward microphone of the earphone, and the feedback sound pressure is a sound pressure of a sound signal picked up by a feedback microphone of the earphone;

determining, according to a comparison result of the difference and a preset first threshold range corresponding to the environment type, whether the earphone is worn properly.

Optionally, the earphone comprises a left-car earphone and a right-ear earphone, and the acquiring a feedforward sound pressure and a feedback sound pressure of the earphone to determine a difference between the feedforward sound pressure and the feedback sound pressure comprises:

acquiring a feedforward sound pressure and a feedback sound pressure of the left-ear earphone to determine a first difference between the feedforward sound pressure and the feedback sound pressure of the left-ear earphone;

acquiring a feedforward sound pressure and a feedback sound pressure of the right-ear earphone to determine a second difference between the feedforward sound pressure and the feedback sound pressure of the right-ear earphone;

the determining, according to the comparison result of the difference and a preset first threshold range corresponding to the environment type, whether the earphone is worn properly comprises:

determining, according to a comparison result of the first difference and the preset first threshold range corresponding to the environment type, whether the left-ear earphone is worn properly;

determining, according to a comparison result of the second difference and the preset first threshold range corresponding to the environment type, whether the right-ear earphone is worn properly;

and/or, determining, according to a comparison result of a difference between the first difference and the second difference and a preset second threshold range corresponding to the environment type, whether the left-ear earphone and the right-ear earphone are consistently worn.

Optionally, the acquiring an environment type in which environment the earphone is located comprises:

determining the environment type in which environment the earphone is located according to a comparison result of the sound pressure of the sound signal picked up by the feedforward microphone and a preset third threshold;

wherein, if the sound pressure of the sound signal picked up by the feedforward microphone is greater than the third threshold, it is determined that the earphone is in the noise environment type; if the sound pressure of the sound signal picked up by the feedforward microphone is not greater than the third threshold, it is determined that the earphone is in the non-noise environment type.

Optionally, the acquiring an environment type in which environment the earphone is located comprises:

acquiring an input instruction;

if the input instruction indicates that the environment type in which environment the earphone is located is the noise environment type, it is determined that the environment type in which environment the earphone is located is the noise environment type; if the input instruction indicates that the environment type in which environment the earphone is located is the non-noise environment type, it is determined that the environment type in which environment the earphone is located is the non-noise environment type.

Optionally, the method further comprises outputting prompt information on whether the earphone is worn properly.

Optionally, the preset audio signal is a sweep signal, pink noise or white noise.

According to the second aspect of this disclosure, a device for detecting wearing status of an earphone is further provided, comprising a memory having computer program stored thereon, and a processor configured to implement the method for detecting wearing status of the earphone according to any one of preceding embodiments when executing the computer program.

According to the third aspect of this disclosure, an earphone is provided, comprising a speaker, a feedforward microphone, a feedback microphone, and the device for detecting wearing status of an earphone as described above;

the feedforward microphone is configured to pick up a sound signal outside a back cavity of the earphone;

the feedback microphone is configured to pick up a sound signal inside a front cavity of the earphone;

the processor is connected with the feedforward microphone and the feedback microphone respectively, to acquire the sound signal picked up by the feedforward microphone and the sound signal picked up by the feedback microphone;

the processor is connected with the speaker to control the speaker to play a preset audio signal when the earphone is in a non-noise environment type.

Optionally, the earphone further comprises an environment type setting device connected to the processor, and the environment type setting device is configured for a user to set the environment type.

The method and device for detecting wearing status of an earphone, and earphone provided by the embodiments of the present disclosure can be used to detect whether a user wears the earphone properly, so as to improve the coupling degree of the earphone and the human ear, thereby improving the noise reduction performance and sound quality of the earphone.

Other features and advantages of the disclosure will become clear from the following detailed description of exemplary embodiments of the disclosure with reference to the drawings.

BRIEF DESCRIPTION OF THE DRAWINGS

In order to explain technical solutions of embodiments of the present disclosure more clearly, drawings required in the embodiments will be briefly introduced below. It should be understood that the following drawings only show some embodiments of the present disclosure and therefore should not be considered as limiting of the scope. Other drawings may be obtained based on the drawings herein without inventive work for those skilled in the art.

DETAILED DESCRIPTION

Figure 1:
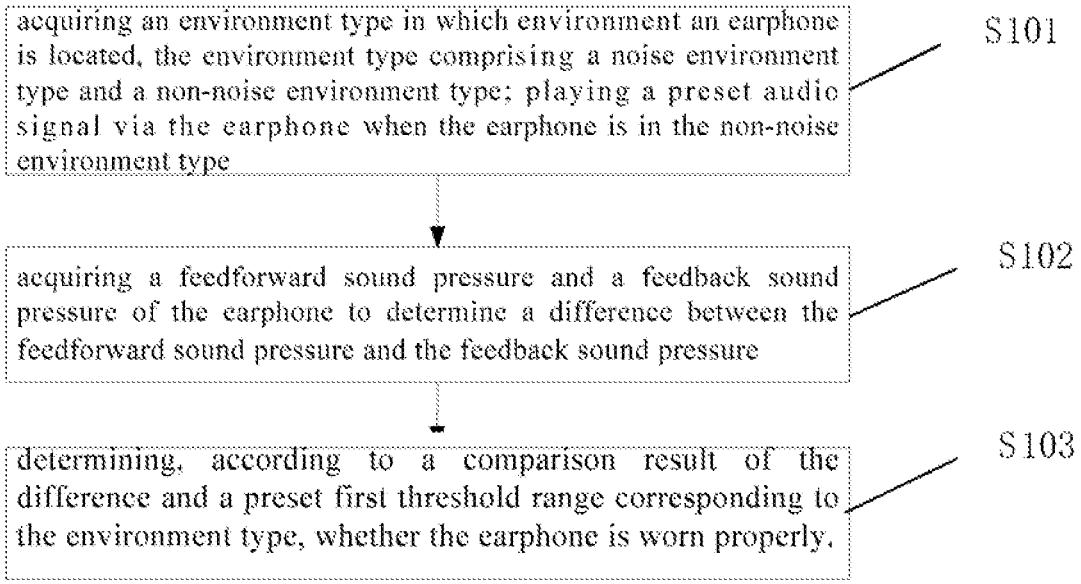
FIG. 1 is a schematic flowchart of a method for detecting wearing status of an earphone provided by an embodiment of the present disclosure.

Various exemplary embodiments of the disclosure will now be described in detail with reference to the drawings. It should be noted that: unless specifically stated otherwise, the scope of the disclosure is not limited by the relative arrangement of components and steps, numerical expressions, and numerical values set forth in these embodiments.

The following description of at least one exemplary embodiment is actually merely illustrative, and in no way serves as any limitation on the disclosure and its application or use.

The technologies, methods, and devices known to those of ordinary skill in the relevant fields may not be discussed in detail, but where appropriate, the technologies, methods, and devices should be regarded as part of the specification.

In all examples shown and discussed herein, any specific values should be interpreted as exemplary only and not as limitations. Therefore, other examples of the exemplary embodiment may have different values.

It should be noted that similar reference numerals and letters indicate similar items in the following drawings, so once an item is defined in one drawing, it does not need to be further discussed in the subsequent drawings.

A method for detecting wearing status of an earphone provided by an embodiment of the present disclosure is executed by a device for detecting wearing status of an earphone. The device may be a variety of earphones, such as Bluetooth earphones, headphones and earbuds. In addition, the earphone may be a single-ear earphone or a binaural earphone. The device may also be various electronic devices including earphones, such as mobile phones and other electronic devices. Alternatively, the device may also be a hardware module and/or software module in an earphone or the above electronic device. It should be noted that in the following embodiments, a method provided in this application will be described with an earphone being used to execute a method for detecting wearing status of an earphone.

As shown in FIG. 1, a schematic flowchart of a method for detecting wearing status of an earphone is provided, comprising the following steps:

S101: acquiring an environment type in which environment an earphone is located, the environment type comprises a noise environment type and a non-noise environment type, and playing a preset audio signal via the earphone when the earphone is in the non-noise environment type.

Specifically, in an actual application scenario where a user uses an earphone, the external environment may be relatively quiet or may be relatively noisy. The embodiment of the present disclosure provides two environment types, including a noise environment type (corresponding to a noisier environment) and a non-noise environment type (corresponding to a quieter environment). In order to determine the environment type in which an earphone is located, optionally, the following two methods are used to obtain the environment type:

Method I:

determining the environment type in which environment the earphone is located according to a comparison result of the sound pressure of the sound signal picked up by the feedforward microphone and a preset third threshold. Wherein, if the sound pressure of the sound signal picked up by the feedforward microphone is greater than the third threshold, it is determined that the earphone is in the noise environment type; and if the sound pressure of the sound signal picked up by the feedforward microphone is not greater than the third threshold, it is determined that the earphone is in the non-noise environment type.

Specifically, if the earphone is a single-car earphone, when acquiring the environment type in which environment the earphone is located based on the above method I, the earphone is configured to detect the sound pressure of the sound signal picked up by the feedforward microphone to obtain a feedforward sound pressure. The earphone is configured to compare the feedforward sound pressure with a third threshold, and if the sound pressure is greater than the third threshold, it is determined that the earphone is in the noise environment type. Otherwise, it is determined that the earphone is in the non-noise environment type.

If the earphone is a binaural earphone, when acquiring the environment type in which environment the earphone is located based on the above method I, the earphone may be configured to determine environment type in which the binaural earphone is located through the sound pressure of the sound signal picked up by the feedforward microphone in either the left-ear earphone or the right-ear earphone according to the method of the single-ear earphone determining the environment type in which the single-ear earphone is located. Of course, the environment type in which environment the earphone is located may also be determined according to the sound pressure of the signals picked up by the two feedforward microphones in the left-car earphone and the right-ear earphone. Specifically, the earphone is configured to detect the sound pressure of the sound signal picked up by the feedforward microphones in the left ear earphone and the right ear earphone. According to the result of comparing the average value or larger value of the two sound pressures with the third threshold, it can be determined the environment type in which environment the earphone is located.

It should be noted that the above third threshold may be set manually. In a specific example, the third threshold may be set to be 40 dB.

Method II:

acquiring an input instruction; if the input instruction indicates that the environment type in which environment the earphone is located is the noise environment type, then it can be determined that the environment type in which environment the earphone is located is the noise environment type; if the input instruction indicates that the environment type in which environment the earphone is located is the non-noise environment type, then it can be determined that the environment type in which environment the earphone is located is the non-noise environment type.

Specifically, the above input instruction is an instruction input by the user of the earphone. The user determines whether the environment type in which environment the earphone is located is a noise environment type or a non-noise environment type through perception of the external environment. The user may input the instruction to the earphone via the relevant button on the earphone. For example, when the user presses the button, the button is pressed, and then the user inputs to the earphone an input instruction that the environment type in which environment the earphone is located is the noise environment type; when the user presses the button again, the button is popped up, and then the user inputs to the earphone an input instruction that the environment type in which environment the earphone is located is the non-noise environment type. Of course, the instruction input can also be implemented in other ways, for example, the instruction input is implemented through a toggle switch, which is not limited in the embodiment of the present disclosure.

Based on the above two implementation, when it is determined that the environment type in which environment the earphone is located is the non-noise environment type, the earphone will play a preset audio signal. When it is determined that the environment type in which environment the earphone is located is the noise environment type, the earphone the earphone may play a preset audio signal, or may not play a preset audio signal. Optionally, in order to better simulate the real noise environment, the above preset audio signal may be a sweep signal, pink noise, or white noise or the like. Of course, the above preset audio signal may also be a piece of music or the like.

S102: acquiring a feedforward sound pressure and a feedback sound pressure of the earphone, so as to determine the difference between the feedforward sound pressure and the feedback sound pressure.

The feedforward sound pressure is a sound pressure of a sound signal picked up by a feedforward microphone of the earphone, and the feedback sound pressure is a sound pressure of a sound signal picked up by a feedback microphone of the earphone.

Specifically, the above feedforward sound pressure and feedback sound pressure refer to the sound pressures of the sound signals picked up by the feedforward microphone and the feedback microphone of the same earphone. When the above step S102 is implemented, the earphone is configured to perform signal processing on the sound signal picked up by the microphone to obtain the feedforward sound pressure and the feedback sound pressure of the earphone.

S103: determining whether wearing of the earphone is proper, according to a result of comparing the difference with a preset first threshold range corresponding to the environment type.

Specifically, when the above difference being calculated, it may be calculated by subtracting the feedback sound pressure from the feedforward sound pressure of the same earphone, or by subtracting the feedforward sound pressure from the feedback sound pressure of the same earphone. The proper wearing of the earphone here means that the influence of noise on the signal of a sound played by the earphone is within an acceptable range for the user. Relatively, the improper wearing of the earphone here means that the influence of noise on the signal of a sound played by the earphone is beyond the acceptable range for the user and cannot satisfy the user. In addition, when the environment types are different and the above difference calculation processes are different, the value of the first threshold range is also different. The specific determination process for the first threshold range is as follows.

When the environment type is the noise environment type, a method for determining the first threshold range corresponding to the noise environment type is as follows.

The user wears the earphone so that the earphone is in an ideal wearing status. Taking a headset as an example, the ideal wearing status means that the user's ear canal opening is in the middle of the earmuff. Speakers in the earphone play, or do not play a preset audio signal which may be a sweep signal, pink noise, white noise or the like.

The sound pressures of the sound signals picked up by the feedforward microphone and the feedback microphone of earphone located on the same side are acquired and recorded as a feedforward sound pressure N(FF) standard and a feedback sound pressure N(FB) standard.

The difference ΔNstandard between the feedforward sound pressure N(FF) standard and the feedback sound pressure N(FB) standard is calculated and recorded as a standard value a.

According to the above standard value a, when it is determined that the environment type in which environment the earphone is located is a noise environment type and is in an ideal wearing status, the acceptable range of the difference between the feedforward sound pressure and the feedback sound pressure is ΔNdiff, and the ΔNdiff is taken as a first threshold range corresponding to the noise environment. In one specific example, the ΔNdiff is an interval (a−3 dB, a+3 dB).

It should be noted that when the environment type is the noise environment type and the first threshold range is determined when speakers in the earphone play an audio signal, then in the process of performing the above S101-S103, when the environment type in which environment the earphone is located is the noise environment type, the speakers in the earphone preferably play the same audio signal. Correspondingly, when the environment type is the noise environment type and the first threshold range is determined when the speakers in the earphone do not play an audio signal, then in the process of performing the above S101-S103, when the environment type in which environment the earphone is located is the noise environment type, the speakers in the earphone preferably do not play the audio signal. In addition, when the standard value a is the feedforward sound pressure minus the feedback sound pressure, the difference determined in S102 is also the feedforward sound pressure minus the feedback sound pressure. When the standard value a is the feedback sound pressure minus the feedforward sound pressure, the difference determined in S102 is also the feedback sound pressure minus the feedforward sound pressure.

When the environment type is a non-noise environment type, a method for determining the first threshold range corresponding to the non-noise environment type is as follows.

The user wears the earphone so that the earphone is in an ideal wearing status. Speakers in the earphone play a preset audio signal which may be a sweep signal, pink noise, white noise or the like.

The sound pressures of the sound signals picked up by the feedforward microphone and the feedback microphone of earphone located on the same side are acquired and recorded as a feedforward sound pressure S(FF) standard and a feedback sound pressure S(FB) standard.

The difference ΔSstandard between the feedforward sound pressure S(FF) standard and the feedback sound pressure S(FB) standard is calculated and recorded as a standard value b.

According to the above standard value b, when it is determined that the environment type in which environment the earphone is located is a non-noise environment type and the earphone is in an ideal wearing status, an acceptable range of the difference between the feedforward sound pressure and the feedback sound pressure is ΔSdiff, and the ΔSdiff is taken as a first threshold range corresponding to the non-noise environment. In one specific example, the ΔSdiff is an interval (b−3 dB, b+3 dB).

It should be noted that when the standard value b is the feedforward sound pressure minus the feedback sound pressure, the difference determined in S102 is also the feedforward sound pressure minus the feedback sound pressure. When the standard value b is the feedback sound pressure minus the feedforward sound pressure, the difference determined in S102 is also the feedback sound pressure minus the feedforward sound pressure.

When implementing the above S103, if the earphone is a single-ear earphone, firstly selecting a first threshold range corresponding to the determined environment type according to the environment type determined in S101; then comparing the difference in S103 with the first threshold range corresponding to the environment type; when the difference exceeds the first threshold range, determining that the earphone is worn improperly, and correspondingly, when the difference is within the first threshold range, determining that the earphone is properly worn. When the earphone is a binaural earphone, for the earphone on either side, it can be determined whether the earphone on that side is properly worn according to the above method, and the result of the determination is used as the wearing status of the binaural earphone.

The method for detecting wearing status of an earphone provided by the present disclosure is able to detect wearing status of the earphone with the hardware device of the earphone. Based on this, a user may determine whether the pose of the earphone needs to be adjusted according to the detection result, thereby improving the coupling degree between the earphone and the human ear, and further improving the noise reduction performance and sound quality of the earphone.

In real life, the binaural headphone is more widely used than the single-ear headphone. The binaural headphone comprises a left-ear headphone and a right-ear headphone. In order to accurately determine whether the earphone on each side of the binaural headphone is worn properly, on the basis of S102 and S103 in the above implementation, the present disclosure provides a method for detecting wearing status of a binaural headphone, and this method comprises:

S201: acquiring a feedforward sound pressure and a feedback sound pressure of the left-ear earphone to determine a first difference between the feedforward sound pressure and the feedback sound pressure of the left-ear earphone.

S202: acquiring a feedforward sound pressure and a feedback sound pressure of the right-ear earphone to determine a second difference between the feedforward sound pressure and the feedback sound pressure of the right-ear earphone.

Specifically, the specific implementation methods of the above S201 and S202 are the same as that of the S102, and will not be repeated here.

Based on the above contents, the above S103 is replaced with:

S2031: determining, according to a comparison result of the first difference and a preset first threshold range corresponding to the environment type, whether the left-ear earphone is worn properly.

S2032: determining, according to a comparison result of the second difference and the preset first threshold range corresponding to the environment type, whether the right-ear earphone is worn properly.

Specifically, the implementations of the S2031 and S2032 are the same as that of the S103, and will not be repeated here.

S2033: determining, according to a comparison result of a difference between the first difference and the second difference, and a preset second threshold range corresponding to the environment type, whether the left-ear earphone and the right-ear earphone are consistently worn.

Specifically, here the above earphones being consistent worn means that the pose of the left-car earphone relative to the left ear is similar to the pose of the right-ear earphone relative to the right ear. Conversely, if the pose of the left-ear earphone relative to the left ear is not similar to the pose of the right-ear earphone relative to the right ear, it means that the wearing of the left-ear earphone and that of the right-ear earphone are inconsistent. The pose herein may comprise position and/or posture. In addition, when the environment types are different, the values of the second threshold ranges may also be different, and the specific determination process for the second threshold ranges is as follows.

When the environment type is the noise environment type, a method for determining the second threshold range corresponding to the noise environment type is as follows.

The user wears the earphone so that the earphone is in an ideal wearing status and the wearing of the left-ear earphone and that of right-ear earphone are consistent. Speakers in the earphone play an audio signal or do not play the audio signal.

A difference between the standard value a of the left-ear earphone and the standard value a of the right-ear earphone is calculated and recorded as a standard deviation aa. The method for determining the standard value a of the left-ear earphone and that of the right-ear earphone is the same as the method for determining the standard value a involved in the process of determining the first threshold range when the environment type is a noise environment type.

According to the above standard deviation value aa, an acceptable difference range ΔNdiff (LR) is determined and servers as a second threshold range corresponding to the noise environment type. In one specific example, the ΔNdiff (LR) is an interval (aa−3 dB, aa+3 dB).

When the environment type is a non-noise environment type, a method for determining the second threshold range corresponding to the non-noise environment type is as follows.

The user wears the earphone so that the earphone is in an ideal wearing status and the wearing of the left-ear earphone and that of the right-ear earphone are consistent. Speakers in the earphone play an audio signal. The played audio signal may be a sweep signal, pink noise, white noise or the like.

A difference between a standard value b of the left-ear earphone and that of the right-ear earphone is calculated and recorded as a standard deviation bb. The method for determining the standard value b of the left-ear earphone and that of the right-ear earphone is the same as the method for determining the standard value b involved in the process of determining the first threshold range when the environment type is the non-noise environment type.

According to the above standard deviation value bb, an acceptable difference range ΔSdiff(LR) is determined and servers as a second threshold range corresponding to the non-noise environment type. In one specific example, the ΔSdiff(LR) is an interval (bb−3 dB, bb+3 dB).

When implementing the S2033, if the difference between the first difference and the second difference is within the second threshold range, it is determined that the wearing of the left-car earphone and that of the right-car earphone are consistent. Conversely, if the difference between the first difference and the second difference exceeds the second threshold range, it is determined that the wearing of the left-car earphone and that of the right-ear earphone are inconsistent.

Based on the above contents, it can be seen that the method for detecting wearing status of a binaural earphone provided by this embodiment can not only detect whether the left-ear earphone and the right-ear earphone are worn properly, but also can detect whether the left-ear earphone and the right-ear earphone are consistently worn, thus improving the user experience.

In one embodiment, in order to inform the wearing status of the earphone to the user timely and effectively so as to prompt the user to adjust the pose of the earphone, the specific wearing status will be prompted accordingly after determining whether the earphone is worn properly. In other words, after the S103 and/or S2031-S2032, the following steps are further included:

S104: outputting prompt information on whether the earphone is worn properly.

Specifically, when it is determined that the earphone is not worn properly, a voice indicating improper wearing may be output such as "the left-ear earphone is not worn properly", "the earphone is not worn properly", and "the wearing of the earphones are inconsistent". Of course, it can also be prompted by flashing lights, lights of different colors, etc.

Figure 2:
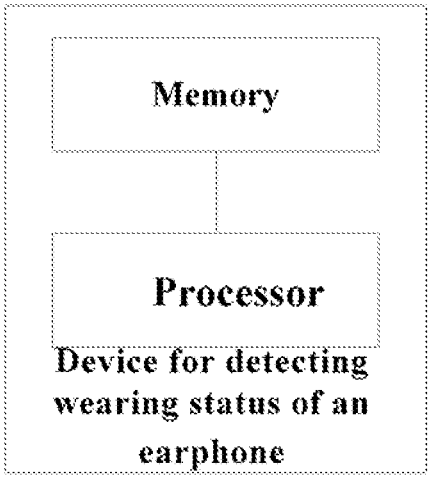
FIG. 2 is a block diagram of a device for detecting wearing status of an earphone provided by an embodiment of the present disclosure.

In an embodiment, the present disclosure provides an earphone, as shown in FIG. 2, comprising: a memory and a processor, the memory storing computer instructions; the processor implementing following steps when executing computer program:

acquiring an environment type in which environment the earphone is located, wherein the environment type comprises a noise environment type and a non-noise environment type; when the earphone is in the non-noise environment type, the earphone plays a preset audio signal;

acquiring a feedforward sound pressure and a feedback sound pressure of the earphone to determine a difference between the feedforward sound pressure and the feedback sound pressure; wherein the feedforward sound pressure is a sound pressure of a sound signal picked up by a feedforward microphone of the earphone, and the feedback sound pressure is a sound pressure of a sound signal picked up by a feedback microphone of the earphone;

determining, according to a comparison result of the difference and a preset first threshold range corresponding to the environment type, whether the earphone is worn properly.

In an embodiment, the earphone comprises a left-ear earphone and a right-ear earphone, and the processor further implements the following steps when executing the computer program:

acquiring a feedforward sound pressure and a feedback sound pressure of the left-car earphone to determine a first difference between the feedforward sound pressure and the feedback sound pressure of the left-ear earphone;

acquiring a feedforward sound pressure and a feedback sound pressure of the right-ear earphone to determine a second difference between the feedforward sound pressure and the feedback sound pressure of the right-ear earphone;

determining, according to a comparison result of the first difference and the preset first threshold range corresponding to the environment type, whether the left-ear earphone is worn properly;

determining, according to a comparison result of the second difference and the preset first threshold range corresponding to the environment type, whether the right-ear earphone is worn properly;

and/or, determining, according to a comparison result of a difference between the first difference and the second difference, and a preset second threshold range corresponding to the environment type, whether the left-ear earphone and the right-ear earphone are consistently worn.

In an embodiment, the processor further implements the following steps when executing the computer program:

determining the environment type in which environment the earphone is located according to a comparison result of the sound pressure of the sound signal picked up by the feedforward microphone and a preset third threshold;

wherein, if the sound pressure of the sound signal picked up by the feedforward microphone is greater than the third threshold, it is determined that the earphone is in the noise environment type; if the sound pressure of the sound signal picked up by the feedforward microphone is not greater than the third threshold, it is determined that the earphone is in the non-noise environment type.

In an embodiment, the processor further implements the following steps when executing the computer program:

acquiring an input instruction;

if the input instruction indicates that the environment type in which environment the earphone is located is the noise environment type, then it is determined that the environment type in which environment the earphone is located is the noise environment type; if the input instruction indicates that the environment type in which environment the earphone is located is the non-noise environment type, then it is determined that the environment type in which environment the earphone is located is the non-noise environment type.

In an embodiment, the processor further implements the following steps when executing the computer program:

outputting prompt information corresponding to whether the earphone is worn properly.

In an embodiment, the preset audio signal is a sweep signal, pink noise, or white noise.

Figure 3:
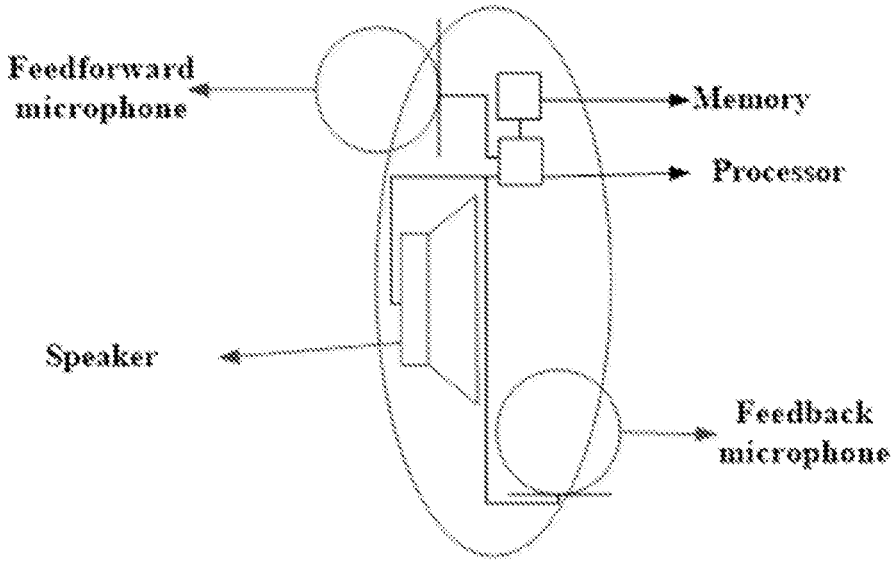
FIG. 3 is a schematic structural diagram of an earphone provided by an embodiment of the present disclosure.

In an embodiment, the present disclosure provides an earphone, as shown in FIG. 3, comprising: a speaker, a feedforward microphone, a feedback microphone, a memory and a processor, wherein:

the feedforward microphone is configured to pick up a sound signal outside a back cavity of the earphone;

the feedback microphone is configured to pick up a sound signal inside a front cavity of the earphone;

the processor is connected with the feedforward microphone and the feedback microphone, respectively, to acquire the sound signal picked up by the feedforward microphone and the sound signal picked up by the feedback microphone;

the memory is configured to store a preset audio signal; and the processor is connected with the speaker and the memory, respectively, to control the speaker to play the preset audio signal when the earphone is in a non-noise environment type.

Figure 4:
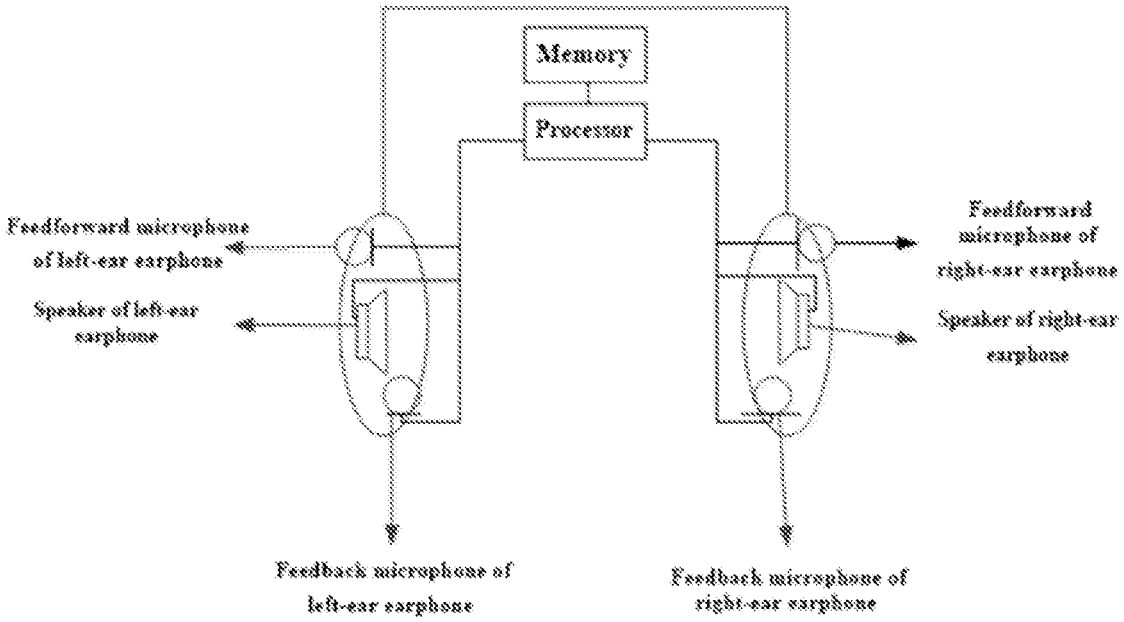
FIG. 4 is a schematic structural diagram of an earphone provided by another embodiment of the present disclosure.

In an embodiment, as shown in FIG. 4, the above feedforward microphone comprises a feedforward microphone of a left-ear earphone and a feedforward microphone of a right-ear earphone; the feedback microphone comprises a feedback microphone of the left-ear earphone and a feedback microphone of the right-ear earphone, and the speakers comprises a speaker of the left-ear earphone and a speaker of the right-ear earphone;

wherein the feedforward microphone of the left-ear earphone is configured to pick up a sound signal outside a back cavity of the left-ear earphone, and the feedforward microphone of the right-ear earphone is configured to pick up a sound signal outside a back cavity of the right-ear earphone;

the feedback microphone of the left-ear earphone is configured to pick up a sound signal inside a front cavity of the left-ear earphone; the feedback microphone of the right-ear earphone is configured to pick up a sound signal inside a front cavity of the right-ear earphone;

the processor is connected with the feedforward microphone of the left-ear earphone and the feedforward microphone of the right-ear earphone, and the feedback microphone of the left-ear earphone and the feedback microphone of the right-ear earphone, respectively, to acquire the sound signals picked up by the feedforward microphone of the left-ear earphone, the feedforward microphone of the right-ear earphone, the feedback microphone of the left-ear earphone and the feedback microphone of the right-ear earphone;

the processor is connected to the speaker of the left-ear earphone and the speaker of the right-ear earphone, respectively, to control the speaker of the left-ear earphone to play the preset audio signal when the left-ear earphone is in a non-noise environment, and/or, to control the speaker of the right-ear earphone to play the preset audio signal when the right-ear earphone is in a non-noise environment.

In an example, the earphone further comprises an environment type setting device connected to the processor, and the environment type setting device is configured for a user to set the environment type.

The present disclosure may be a computer program product. The computer program product may comprise a computer readable storage medium having computer readable program instructions stored thereon for enabling the processor to implement various aspects of the present disclosure.

The computer readable storage medium can be a physical device capable of retaining and storing an instruction for use by an instruction execution device. The computer-readable storage medium may be, for example, but not limited to, an electrical storage device, a magnetic storage device, an optical storage device, an electromagnetic storage device, a semiconductor storage device, or any suitable combination thereof. More specific examples (non-exhaustively listed) of the computer readable storage medium comprise: a portable computer disk, a hard disk, a random access memory (RAM), a read-only memory (ROM), an erasable programmable read-only memory (EPROM or flash memory), a static random access memory (SRAM), a portable compact disk read-only memory (CD-ROM), a digital video disk (DVD), a memory stick, a floppy disk, a mechanical encoding device, such as a punch card or an in-groove protrusion structure having stored therein an instruction, and any appropriate combinations thereof. The computer readable storage medium used herein is not explained as an instantaneous signal, such as a radio wave or other freely transmitted electromagnetic waves, an electromagnetic wave transmitted via a waveguide or other transmission medium (for example, a light pulse passing an optical fiber cable), or an electrical signal transmitted via an electric wire.

The computer readable program instruction described herein can be downloaded from the computer readable storage medium to a computing/processing device, or downloaded to an external computer or an external storage device via a network, such as an Internet, a local area network, a wide area network and/or a wireless network. The network may comprise a copper transmission cable, an optical fiber transmitter, a wireless transmitter, a router, a firewall, a switch, a gateway computer and/or an edge server. A network adapter card or a network interface in each computing/processing device receives the computer readable program instruction from the network, and forwards the computer readable program instruction, so as to store the computer readable program instruction in the computer readable storage medium of the computing/processing device.

The computer program instruction used to perform the operations of the present disclosure may be assembly instruction, instruction set architecture (ISA) instruction, machine instruction, machine-related instruction, microcode, firmware instruction, status setting data, or source code or object code written in any combination of one or more programming languages. The programming languages include object-oriented programming languages such as Smalltalk, C++, etc., and conventional procedural programming languages such as "C" language or similar programming languages. The computer readable program instruction can be completely executed on a user computer, partially executed on the user computer, executed as an independent software packet, executed partially on the user computer and partially on a remote computer, or completely executed on the remote computer or a server. In the case of involving a remote computer, the remote computer can be connected to the user computer via any types of networks, such as a local area network (LAN) or a wide area network (WAN), or can be connected to an external computer (for example, via an Internet provided by an Internet service supplier). In some embodiments, an electronic circuit, such as a programmable logic circuit, a field programmable gate array (FPGA), or a programmable logic array (PLA), can be customized by using the status information of the computer-readable program instructions. The electronic circuit can execute computer-readable program instructions to implement various aspects of the present disclosure.

Here, various aspects of the present disclosure are described with reference to flowcharts and/or block diagrams of methods, devices (systems) and computer program products according to embodiments of the present disclosure. It should be understood that each block in the flow charts and/or the block diagrams can be combined with another block in the flow charts and/or the block diagrams via computer readable program instructions.

The computer readable instructions can be supplied to the processors of a general-purpose computer, a specialized computer, or other programmable data processing devices, so as to produce a machine, such that when the instruction is executed by the processors of the computers or other programmable data processing devices, a device for realizing a specified function/action in one or more blocks in the flow charts and/or the block diagrams can be generated. The computer readable program instructions can also be stored in a computer readable storage medium; the instructions enable a computer, a programmable data processing device and/or other devices to operate in a specific mode; therefore, the computer readable medium having stored therein the instructions becomes a product comprising various instructions for realizing a specified function/action in one or more blocks in the flow charts and/or the block diagrams.

The computer readable program instructions can also be loaded to a computer, other programmable data processing devices, or other devices, such that a series of operation steps can be executed on the computer, other programmable devices or other devices to generate a computer realized process; therefore, the computer, other programmable devices or other devices can execute the instructions to realize a specified function/action in one or more blocks in the flow charts and/or the block diagrams.

The flowcharts and block diagrams in the drawings show the possible implementation of the system architecture, functions, and operations of the system, method, and computer program product according to a plurality of embodiments of the present disclosure. In this respect, each block in the flow charts or the block diagrams may represent a module, a program segment or a part of an instruction; the module, the program segment or a part of an instruction comprise one or more executable instructions for realizing a specified logic function. In an alternative implementation, the functions marked in the blocks can also occur in an order different from the sequence in the drawings. For example, two sequent blocks actually can be executed basically in parallel, and sometimes can also be executed in a reverse order, which depends on the involved functions. It should be further noted that each block in the block diagrams and/or the flow charts, and a combination of the blocks in the block diagrams and/or the flow charts can be realized via a hardware based system specially for executing a specified function or action, or via a combination of special hardware and a computer instruction. It is well known to those skilled in the art that implementation through hardware, implementation through software, and implementation through a combination of software and hardware are all equivalent.

The embodiments of the present disclosure have been described above, and the foregoing description is illustrative, not limiting, and not limited to the disclosed embodiments. Numerous modifications and changes will be apparent to those skilled in the art without departing from the scope and spirit of the illustrated embodiments. The choice of terms used herein is intended to best explain the principles, practical applications, or the technical improvements in the market, of the embodiments, or to enable other ordinary skilled in the art to understand the embodiments disclosed herein. The scope of the present disclosure is defined by the attached claims.

The invention claimed is:

1. A method for detecting a wearing status of an earphone, comprising:

acquiring an environment type comprising a noise environment type and a non-noise environment type;

playing a preset audio signal via the earphone when the earphone is in the non-noise environment type;

acquiring a feedforward sound pressure and a feedback sound pressure of the earphone to determine a difference therebetween, wherein the feedforward sound pressure is a sound pressure of a sound signal picked up by a feedforward microphone of the earphone, and the feedback sound pressure is a sound pressure of a sound signal picked up by a feedback microphone of the earphone;

determining, according to a comparison of the difference and a preset first threshold range corresponding to the environment type, whether the earphone is worn properly.

2. The method according to claim 1, wherein the earphone comprises a left-ear earphone and a right-ear earphone, and the acquiring a feedforward sound pressure and a feedback sound pressure of the earphone to determine a difference therebetween comprises:

acquiring a feedforward sound pressure and a feedback sound pressure of the left-ear earphone to determine a first difference therebetween;

acquiring a feedforward sound pressure and a feedback sound pressure of the right-ear earphone to determine a second difference therebetween;

and wherein the determining whether the earphone is worn properly, comprises:

determining according to a comparison result of the first difference and the preset first threshold range corresponding to the environment type, whether the let-ear earphone is worn properly;

determining, according to a comparison result of the second difference and the preset first threshold range corresponding to the environment type, whether the right-ear earphone is worn properly;

and/or, determining, according to a comparison result of a difference between the first difference and the second difference and a preset second threshold range corresponding to the environment type, whether the left-ear earphone and the right-ear earphone are consistently worn.

3. The method according to claim 1, wherein the acquiring an environment comprises:

determining the environment type in which environment the earphone is located according to a comparison result of the sound pressure of the sound signal picked up by the feedforward microphone and a preset third threshold;

wherein, if the sound pressure of the sound signal picked up by the feedforward microphone is greater than the third threshold, it is determined that the earphone is in a noise environment type; if the sound pressure of the sound signal picked up by the feedforward microphone is not greater than the third threshold, it is determined that the earphone is in a non-noise environment type.

4. The method according to claim 3, wherein the third threshold is 40 dB.

5. The method according to claim 1, wherein the acquiring an environment type in which environment the earphone is located comprises:

acquiring an input instruction;

if the input instruction indicates that the environment type is the noise environment type, it is determined that the environment type in which environment the earphone is located is the noise environment type; if the input instruction indicates that the environment type is the non-noise environment type, it is determined that the environment type in which environment the earphone is located is the non-noise environment type.

6. The method according to claim 1, wherein the method further comprises:

outputting prompt information on whether the earphone is worn properly.

7. The method according to claim 1, wherein the preset audio signal is a sweep signal, pink noise or white noise.

8. A device for detecting wearing status of an earphone, comprising:

a memory having computer program stored thereon, and a processor, configured to implement the method according to claim 1 when executing the computer program.

9. An earphone, comprising a speaker, a feedforward microphone, a feedback microphone, and the device according to claim 8;

the feedforward microphone is configured to pick up a sound signal outside a back cavity of the earphone;

the feedback microphone is configured to pick up a sound signal inside a front cavity of the earphone;

the processor is connected with the feedforward microphone and the feedback microphone respectively, to acquire the sound signal picked up by the feedforward microphone and the sound signal picked up by the feedback microphone;

the processor is connected with the speaker to control the speaker to play a preset audio signal when the earphone is in a non-noise environment type.

10. The earphone according to claim 9, wherein the earphone further comprises an environment type setting device connected to the processor, and the environment type setting device is configured for a user to set the environment type.

11. A non-transitory computer-readable storage medium storing computer program, wherein the computer-readable storage medium can implement the method of claim 1 when the computer program is executed.

* * * * *